FTP8011 OR 4,019,576

United States Patent [19]

Finch

[11] 4,019,576

[45] Apr. 26, 1977

[54] OIL RECOVERY FROM AN OIL-WATER WELL

[75] Inventor: William C. Finch, Houston, Tex.

[73] Assignees: William C. Finch; Michael P. Breston, both of Houston, Tex. ; part interest to each

[22] Filed: Nov. 23, 1973

[21] Appl. No.: 418,482

[52] U.S. Cl. ..... 166/250; 166/314

[51] Int. Cl.[2] ..... E21B 43/12; E21B 47/04

[58] Field of Search ..... 166/314, 305, 285, 292, 166/250, 254

[56] References Cited

UNITED STATES PATENTS

| | | | |
|---|---|---|---|
| 2,018,700 | 10/1935 | Blau | 166/314 |
| 2,387,361 | 10/1945 | Stephenson | 166/305 R |
| 2,593,497 | 4/1952 | Spearow | 166/305 R |
| 3,032,499 | 5/1962 | Brown | 166/305 R |
| 3,093,192 | 6/1963 | Allen | 166/305 R X |
| 3,455,394 | 7/1969 | Knight | 166/314 |
| 3,638,731 | 2/1972 | Driscoll | 166/314 |

*Primary Examiner*—Stephen J. Novosad
*Attorney, Agent, or Firm*—Michael P. Breston

[57] ABSTRACT

This invention relates to the recovery of oil from an oil well which normally produces a mixture of oil and water. The invention is carried out by determining the potential free water level in the well bore, draining the oil gravitationally from a point above the predetermined water level, and withdrawing the drained oil.

2 Claims, 2 Drawing Figures

OIL RECOVERY FROM AN OIL-WATER WELL

REFERENCE TO RELATED APPLICATION

This application is related to my co-pending application Ser. No. 324,461 and now U.S. Pat. No. 3,901,811.

BACKGROUND OF THE INVENTION

The problem of trying to produce water-free oil from an oil reservoir in which water is an integral part of the environment is as old as the oil business. Although this problem occurs at any stage in the life of an oil well, from date of discovery to abandonment, it becomes increasingly vexatious with time and the decline of oil reserves in the field. Ultimately, when the lifting costs of the combined oil and water exceed the value of the recovered oil, abandonment becomes the only alternative. As production nears this stage, the local area of the oilfield is considered as being exhausted and the well is termed a "stripper".

Many procedures have been tried to produce water-free oil. As far as I know, the most widely used method involves emplacing a cement plug at the oil-water contact, perforating the casing above but near the oil-water contact to allow the oil to enter into the casing, and pumping from a position close to the cement plug to insure that there is a sufficient column of oil to pump from, since the oil column in stripper wells is typically quite thin. Another procedure sometimes used consists of injecting just above the oil-water contact, a "sheet" of cement into a large peripheral area through a ring of perforations in the casing with the objective of blocking off rising water. As pumping resumes, however, removal of oil from the water table permits the water to rise slowly in its place and hence the remedial step must be re-performed.

Yet another method has been tried without much success. An open-ended casing is run down to within about a foot above the top of the oil zone, without entering it. Then a pump is installed in the casing so its operation pulls oil up through the bottom of the casing. This method fails after some oil is produced because water comes up through and with the oil.

In most oil-water producing wells, with each suction stroke of the pump, as it draws fluids into the bore, sand and silt also flow into the well bore through the bottom of the well or through casting perforations. This problem is normally handled by "cementing off" the sands arriving through existing perforations, and reperforating the casing at some point above the cemented zones. As production decreases, the process is repeated.

To control such sand and silt inflows, many operators have employed the water well driller's technique of gravel packing an annular space around the perforated casing that straddles the oil saturated zone. This technique is successful in precluding sand and it allows the operator to pump fluid at higher rates, in ratios of up to 100 bbls. of water to 1 bbl. of oil, but here the water problem increases. However, there is some compensation to the operator in this method because the induced cone of depression in the water table affects a relatively larger area than the immediate well-bore and draws in oil from the entire area affected by this method. With this compensation comes a greater need for separating oil from water and disposing of the latter, usually brine. Thus fluid lifting costs increase and brine disposal also requires increasing expenditures.

SUMMARY OF THE INVENTION

A method and apparatus for the recovery of oil from a well which normally produces a mixture of oil and water by pre-determining the potential free water level in the well bore and withdrawing oil from a point above the predetermined water level. A preferred apparatus removes oil that overlies formation water by skimming off the oil into a perforated pipe that is suspended vertically in the well. The pipe forms an oil chamber which extends deep down, say several tens of feet, into the water table. The perforations are made in the pipe after a study of the potential free water level in the well under static conditions. With the pipe thus positioned, the pipe serves as a storage reservoir, below the oil-water interface, into which only oil can flow gravitationally from above, through the aforementioned perforations. The oil is then pumped out to the surface.

Occasionally, in cases of fluctuating water levels, it may be necessary to provide a filter that is both oleophyllic and hydrophobic over the perforations of the pipe to "strain out" outside water. This application of the method will apply most suitably to non-viscous oils.

BRIEF DESCRIPTION OF THE DRAWINGS

In the drawings the same numerals will be used whenever possible to designate the same or similar parts.

FIG. 1 shows a prior art stripper well 10 for producing oil from an oil layer 12 lying above a water table 14 in a reservoir 16. The oil-water interface in the well is designated as 18. Well 10 is cased with appropriate steel casing 20 and is provided with a total depth (TD) cement plug back 21 and with an upper cement plug 22 at or very near to the oil-water interface 18. Perforations 24 are made in the casing 20 slightly above the actual oil-water interface 18. The perforations permit oil 12 to enter the inner volume of the casing above plug 22. To withdraw the oil from the casing, there is employed a tubing 30 to the lower end of which is attached a suitable pump 32.

Figure 1:
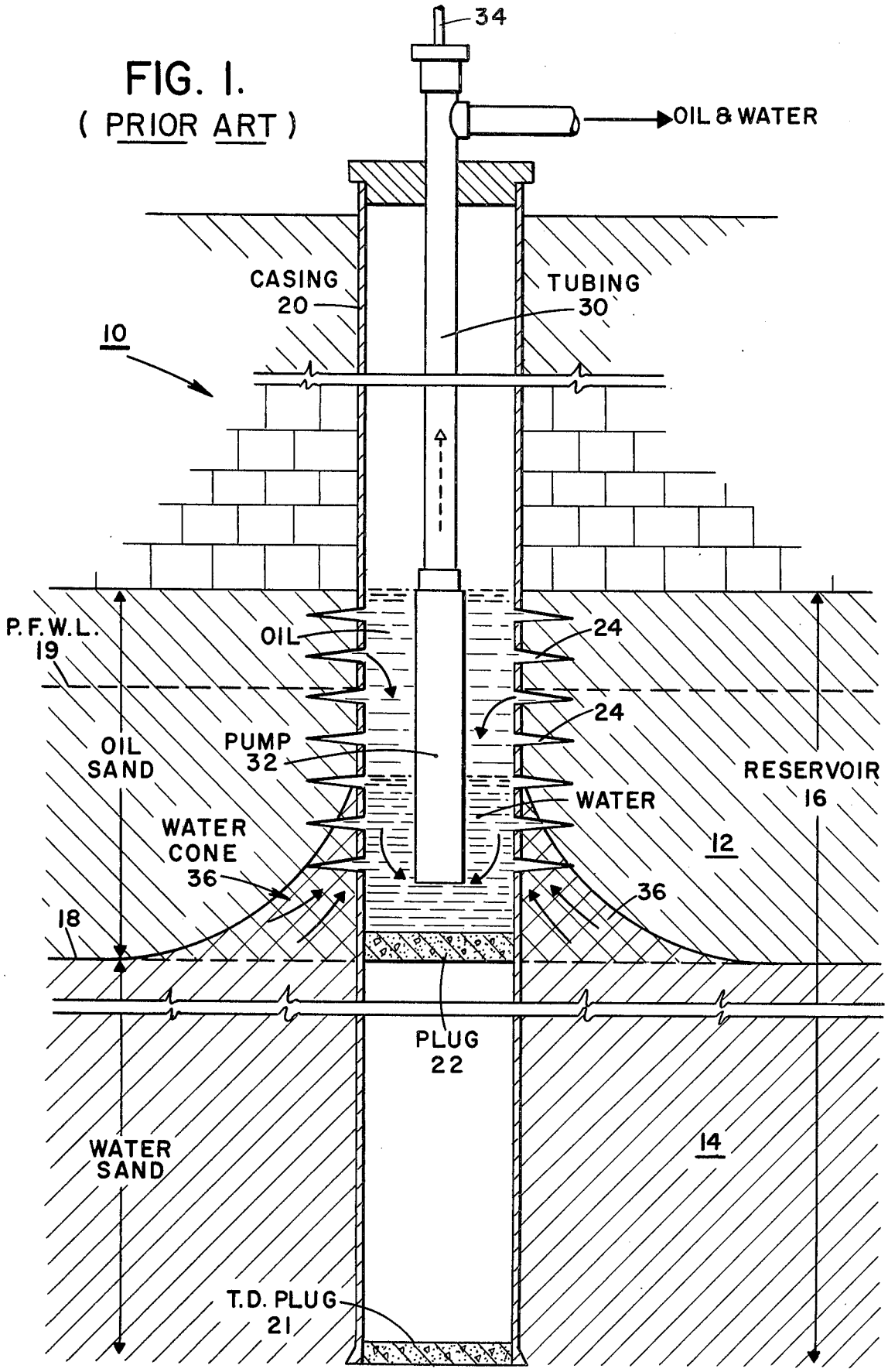
FIG. 1. ( PRIOR ART )
FIG. 1 schematically illustrates a prior art stripper well.

Originally, when the well started producing, the oil layer 12 may have had a thickness ranging from one foot to one thousand feet or more. This layer could lie from a hundred feet to 10,000 feet or more below the earth's surface. Continued production of oil from this oil well gradually reduces the thickness of this oil layer and permits the oil-water interface 18 to gradually rise. It can rise to its maximum level 19, herein called the "potential free water level" (PFWL). The determination of the PFWL 19 and its use are important aspects of my invention, as will be subsequently described. The oil is pumped from the well by the lifting operation of pump 32. It is manipulated in a conventional manner by sucker rods 34 and by a pump jack (not shown). The thusly produced oil is conducted to surface storage facilities. If the oil is not lifted very slowly, the water table "cones up" as at 36 thereby allowing water to enter the casing. As the thickness of the oil layer decreases, the water problem becomes gradually worse and the pump will be required to lift an increasing volume of water.

Figure 2:
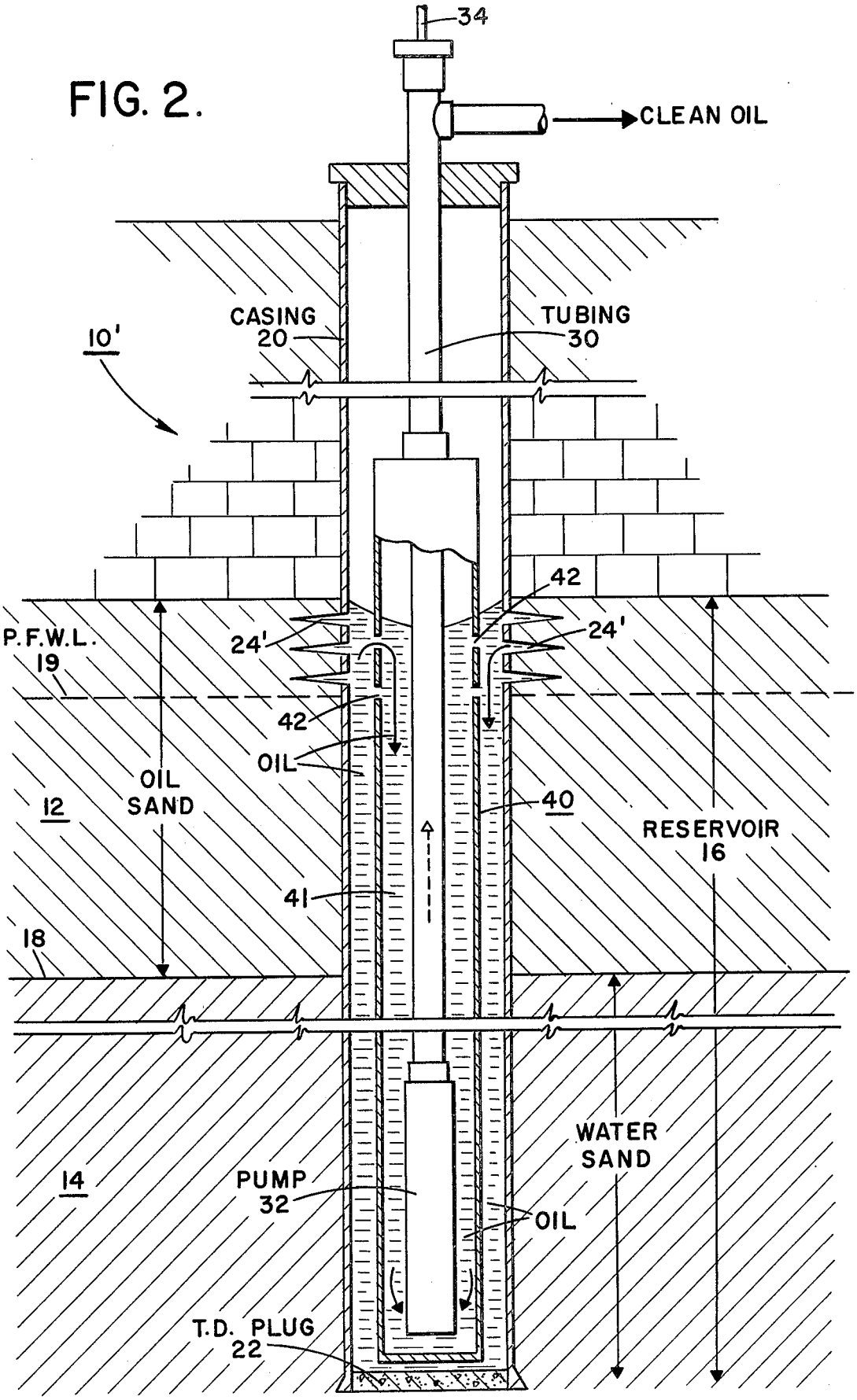
FIG. 2 schematically illustrates the operation of a skimmer well in accordance with this invention.

FIG. 2 illustrates my novel method as applied to a preferred embodiment of my invention. The oil well 10' is desirably drilled to a greater depth. It is provided with a TD cement plug 22 at the bottom of the well.

My invention is based on a foreknowledge of the potential free water level 19, which is the maximum level to which water will rise in the well bore if no oil were present therein. The position of the PFWL 19 relative to the oil water contact 18 can be determined, for example, by measuring the thickness of the layer of oil 12 and multiplying it by the specific gravity of the oil. A correction can be made for the case of high-density salt water. An "Amerada Bomb" suitably suspended from a calibrated cable can be used to make the necessary dimensional measurements. Other methods for determining the PFWL 19 will readily suggest themselves to those skilled in the art.

After determining the PFWL 19, oil skimmer ports 24' will be perforated in the casing 20 slightly above the PFWL 19. Oil from the oil layer 12 will now drain gravitionally and accumulate in the portion of casing 20 submerged below the PFWL 19 from which it can be lifted to the surface by a suitable pump in conventional fashion.

In a preferred embodiment for carrying out the method of my invention, I employ a perforated skimmer 40 which is lowered and bottomed on the cement plug 22. The skimmer is provided with at least one or more perforations 42. The inner volume of the skimmer below perforations 42 constitutes a chamber 41 which, as will be apparent from the drawing, extends for several tens of feet below the actual oil-water contact 18 in the well 10. Perforations 42 are made preferably at or near the PFWL 19, although they could be located below that level, if the casing 20 is water tight below perforations 24 and sand inflow to the casing 20 is not a problem. Perforations 42 will permit oil to enter from the inner volume of the casing into the skimmer's chamber 41 which can house a pump 32 at the end of a tubing 30.

Just as in the case of the stripper well 10, the pump jack will work on the sucker rods 34 to vertically withdraw the oil from chamber 41 to storage vessels on the earth's surface.

As previously mentioned, although skimmer 40 is desirable, it is not essential, and if the casing 20 is in good condition, it can be used without the skimmer to form the required chamber 41 above the TD plug 22. Thus, regardless of whether skimmer 40 is employed, oil will gravitionally flow into the casing 20 from which it can be directly withdrawn, or oil from the casing can be allowed to flow gravitionally into chamber 41 in the skimmer 40 from which it is withdrawn to the earth's surface.

An important advantage of my invention is that because of the position of perforations 24' in the casing above the PFWL 19, water will not gravitionally enter into the casing and, hence, water-free oil will be pumped either from the casing itself or from chamber 41 of the skimmer 40. Thus, with my water-excluding invention, only clean oil will be pumped.

The elimination of water production from conventional stripper wells will result in several other advantages such as: small pumps can now be used; the need to dispose of oil-contaminated water from the well is eliminated; and, sand production and the frequency of pump maintenance are considerably reduced if not altogether eliminated.

Moreover, since only oil can gravitationally enter into casing 20 and from casing 20 into chamber 41 of skimmer 40, both the casing and the skimmer act as oil-water separators. The casing and the skimmer each also serves as an oil storage reservoir below the actual oil-water contact 18. Accordingly, the invention has particular application for all stripper wells in old oil fields or whenever water production increases to an intolerable extent.

Also, because my technique involves a slow inflow of oil from a position at or above the potential free water level 19, it eliminates the direct sucking action, normally induced by conventional pumping, which is largely responsible for "sanding-up" an oil well by sucking in loose sand through perforations that connect the well bore with oil saturated sands. Since in accordance with my invention, only oil will flow into the casing through ports 24' which are situated above the PFWL 19 which is well above the actual oil-water contact 18, the pump will lift only oil that is free of sand and water.

Occasionally, in cases of fluctuating water levels it may be desirable and beneficial to provide a filter that is both oleophyllic and hydrophobic. The filter will be positioned over the perforations 24 of casing 20 to strain out the water. A suitable filter material made of Teflon (DuPont Reg. TM) is commercially available under the tradename of "Zitex" and can be purchased from Chemplast, Inc., in Wayne, New Jersey.

It will be appreciated that the drawings were schematically illustrated for reasons of clarity. For example, the cement sheet in the annulus between the casing and the wall of the well bore is not shown.

What I claim is:

1. In a method for the production of a hydrocarbon fluid from an underground formation which is penetrated by a cased well, said hydro-carbon fluid being in contact with water in said formation, said water tending to form a cone and be produced with said hydrocarbon fluid when said well is placed on production, the improvement comprising the steps of:

determining the potential free water level in said well by measuring the height of the hydrocarbon column in said well and multiplying said height by the specific gravity of the hydrocarbon;

withdrawing said hydrocarbon fluid from said well in a noncommingled condition with said water;

producing into said well by gravity said hydrocarbon fluid through spaced perforated intervals in the casing of said well from spaced producing intervals in said formation, said intervals all being substantially above said determined potential free water level; and the casing of said well forming a closed-bottom reservoir extending substantially below the level of the oil-water interface.

2. The method of claim 1, wherein a single production tubing is employed in said casing and the hydrocarbon fluid entry point thereof is at and above said determined potential free water level.

* * * * *